United States Patent [19]

Partington

[11] Patent Number: 4,904,160

[45] Date of Patent: Feb. 27, 1990

[54] MOUNTING OF INTEGRAL PLATFORM TURBINE BLADES WITH SKEWED SIDE ENTRY ROOTS

[75] Inventor: Albert J. Partington, Winter Springs, Fla.

[73] Assignee: Westinghouse Electric Corp., Pittsburgh, Pa.

[21] Appl. No.: 332,187

[22] Filed: Apr. 3, 1989

[51] Int. Cl.[4] ..... F01D 5/32

[52] U.S. Cl. ..... 416/193 A; 416/212 A; 416/220 R

[58] Field of Search ..... 416/193 A, 219 R, 220 R, 416/204 A, 210 A, 212 A

[56] References Cited

U.S. PATENT DOCUMENTS

| | | | |
|---|---|---|---|
| 2,272,831 | 2/1942 | Chalupa | 416/219 R |
| 2,873,947 | 2/1959 | Perry | 416/220 R |
| 3,014,695 | 12/1961 | Rankin et al. | 416/193 A X |
| 3,627,448 | 12/1971 | Rupp et al. | 416/220 |
| 3,702,222 | 11/1972 | Bernales | 416/219 R X |
| 3,746,468 | 7/1973 | Saunders | 416/193 A X |
| 3,867,069 | 2/1975 | Bussell | 416/193 A X |
| 4,130,379 | 12/1978 | Partington | 416/193 A |
| 4,533,298 | 8/1985 | Partington et al. | 416/191 |
| 4,602,412 | 7/1986 | Partington et al. | 29/156.8 |

FOREIGN PATENT DOCUMENTS

| | | | |
|---|---|---|---|
| 1551191 | 4/1970 | Fed. Rep. of Germany | 416/220 R |
| 1812491 | 12/1970 | Fed. Rep. of Germany | 416/220 R |
| 2312821 | 10/1973 | Fed. Rep. of Germany | 416/219 R |
| 23802 | 2/1986 | Japan | 416/193 A |
| 306284 | 8/1971 | U.S.S.R. | 416/193 A |

*Primary Examiner*—Everette A. Powell, Jr.
*Attorney, Agent, or Firm*—K. Bach

[57] ABSTRACT

Method and apparatus for assembling integral platform blade groups to a rotor of a steam turbine in which the platform roots are skewed with respect to the axis of the turbine. The platform roots are formed to define a set of spaced grooves and steeples are formed on the rotor to mate with the platform roots. Grooves on the platform and in the rotor are alignable to accept a connecting member when the steeples are aligned in abutting relationship with platform roots. The connecting member joins the blade group to the rotor. In one form, the bearing surfaces of the steeples, roots and connecting member are formed to lie on one or more circles circumscribing the rotor axis.

5 Claims, 3 Drawing Sheets

MOUNTING OF INTEGRAL PLATFORM TURBINE BLADES WITH SKEWED SIDE ENTRY ROOTS

This invention relates to steam turbines and, more particularly, to a method and apparatus for attaching side entry integral control stage blade groups to a rotor of a steam turbine.

Side entry turbine blade roots are typically formed with Christmas tree-shaped roots which fit into correspondingly shaped grooves in a rotor disc. The roots generally have three lugs on each side of a root centerline. Each lug has an inclined bearing surface which bears against a groove so that each blade root reacts against six bearing surfaces. When each blade is considered as a separate and distinct entity, the blade root surfaces and the groove bearing surfaces can be formed for satisfactory mating relationships and thus provide the desired, when required, support for the blade.

It has become common practice to join individual blades into groups of blades by attachment to a common platform and/or shroud portions. Such multiple blade units have higher rigidity and lower vibration susceptibility than single blades. In one form, a blade group may be constructed by attaching radially outer ends of several blades to a shroud after the blade roots are inserted into their respective rotor grooves. In another form, blade groups may be constructed as integral units having a common shroud and a common platform. Such a blade group is illustrated in U.S. Pat. No. 4,130,379 to Partington and assigned to the assignee of the present invention.

In U.S. patent application Ser. No. 178,724 filed Apr. 6, 1988 and assigned to the assignee of the present invention, there is described one arrangement of integral side entry control stage blade groups utilizing integrally formed shroud and platform sections. In this particular application, the blade roots of a group of blades are arranged to slide into grooves in a rotor in which the grooves are parallel to an axis of the rotor. So long as the assembly of the integral platform blade groups to the rotor requires only that the blade group be moved in a path parallel to the rotor axis, assembly of such blade groups to the rotor has not presented any undue problems not experienced with single blade roots. However, in some control stage blade groups, the grooves formed in the rotor are skewed with respect to the rotor axis. Similarly, the roots on the blade platforms are skewed with respect to the rotor axis so as to fit within the grooves of the rotor. In this latter arrangement, it has been found that it is not possible to assemble the integral blade groups to a rotor because the angular difference between adjacent grooves caused by the circumferential displacement of the grooves forces the roots to bind within the grooves. Thus, it is desirable to provide a method and apparatus for assembling integral platform control stage blades to turbine rotors in those situations where the roots are skewed and not parallel to the turbine axis.

SUMMARY OF THE INVENTION

Among the several objects of the present invention is the provision of a method and apparatus for assembling integral control stage blade groups to a rotor of a steam turbine. More specifically, it is an object of the present invention to provide a method and apparatus for assembling a rotor and an integral controls stage blade group in which the roots of the blade group are skewed and not parallel to the turbine axis.

In accordance with one form of the invention, there is provided a method for assembling integral shroud and platform blades to a rotor of a steam turbine by forming grooves in the turbine rotor so as to define a plurality of steeples having predetermined configurations. Roots are then formed on the blade platform spaced apart to define a plurality of platform grooves. Each of the platform grooves is positioned alignable with a corresponding one of the grooves in the rotor. The end of each of the roots is shaped to conform to the shape of the adjacent radially outer end of each of the rotor steeples. The platform and associated blade roots are positioned so that the platform roots rest on the rotor steeples. A connecting member is then inserted into the aligned grooves of the rotor and blade platform to connect the blade groups to the rotor. In one form, the rotor grooves are formed to define a steeple having a single pair of opposed lugs. The lugs are formed such that the bearing surfaces are positioned on a circle circumscribing the axis of the rotor. The steeple includes a radially shaped outer end having a substantially flat top positioned between angularly oriented side surfaces such that the steeple end appears as a truncated triangle in a cross-sectional view taken transverse to the rotor axis. The ends of the roots on the blade platform are formed to have surfaces which mate with the radially outer ends of the rotor steeples. The roots are also formed with a single pair of opposed lugs. The connecting member is shaped to fit the groove in each of the rotor and the blade platform so as to connect the blade platform to the rotor.

BRIEF DESCRIPTION OF THE DRAWING

For a better understanding of the present invention, reference may be had to the following detailed description taken in conjunction with the accompanying drawings in which.

DETAILED DESCRIPTION OF THE INVENTION

Figure 1:
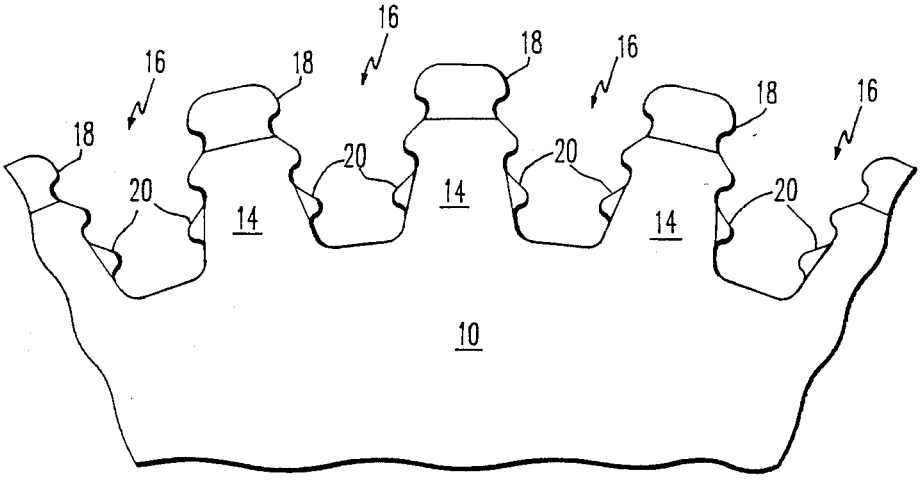
FIG. 1 illustrates a group of rotor steeples of a standard Christmas tree configuration with selected cross-hatched areas indicated as being removed to arrive at a configuration suitable for use in the present invention.

Turning now to FIG. 1, there is shown a partial cross-sectional view taken transverse to an axis of the rotor of the steam turbine illustrating the sequence of Christmas tree shaped steeples formed on the rotor for supporting a plurality of turbine blades. The rotor, indicated at 10, will be recognized to be a solid circular member having a rotational or rotor axis 12 about which the rotor rotates. The steeples 14 define a plurality of spaced grooves 16 into which roots of turbine blades are normally positioned. In the present invention, the steeples are located on a part of the turbine to which control stage blades are normally attached. The control stage blades to which the present invention relates are normally provided with skewed side entry roots. By skewed, it is meant that the roots extend along the rotor axis at an angle skewed with respect to the rotor axis. In prior systems, such skewed side entry roots are formed as individual blades with individual roots and are individually assembled to the rotor by sliding the blade root into the space 16 between adjacent steeples. It is desirable to form such control stage blades in integral groups for assembly onto a rotor. With such integral groups, however, it has been found impossible to slide the blade roots into the grooves 16 since the angles of the roots vary slightly from root to root due to the circumferential displacement along the rotor surface. The present invention provides a method for attaching such integral groups of control stage blades to a rotor by modifying the method and apparatus for attaching such blades.

Figure 2:
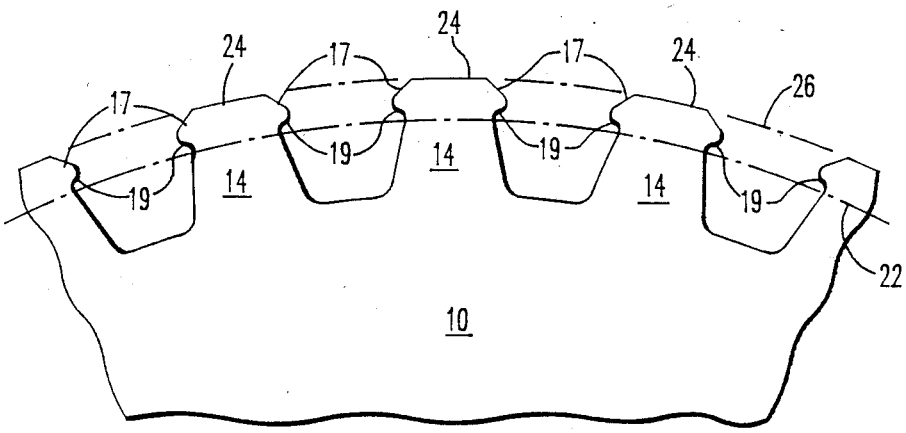
FIG. 2 illustrates a plurality of rotor steeples after removal of the areas indicated in FIG. 1.

In FIG. 1, the areas indicated at 18 and 20 are either removed from or not formed on the rotors in order to arrive at the rotor steeple shape as shown in FIG. 2. It will be noted in FIG. 2 that each of the steeples includes only a single pair of opposed lugs 17 located near the radially outer portion of the steeple. The steeples are shaped with substantially a flat top and with angularly displaced sides on each side of the flat top so as to form an apparent truncated triangle when viewed in cross-section as shown in FIG. 2.

Preferably, the bearing surfaces 19 of each of the rotor steeples of FIG. 2 is located on an arc of a circle centered on the rotor axis 12 as indicated by the dashed line 22. Similarly, it is desirable that the flat top 24 of each of the steeples 14 is also located on an arc of a circle centered on the rotor axis as indicated at 26.

Figure 3:
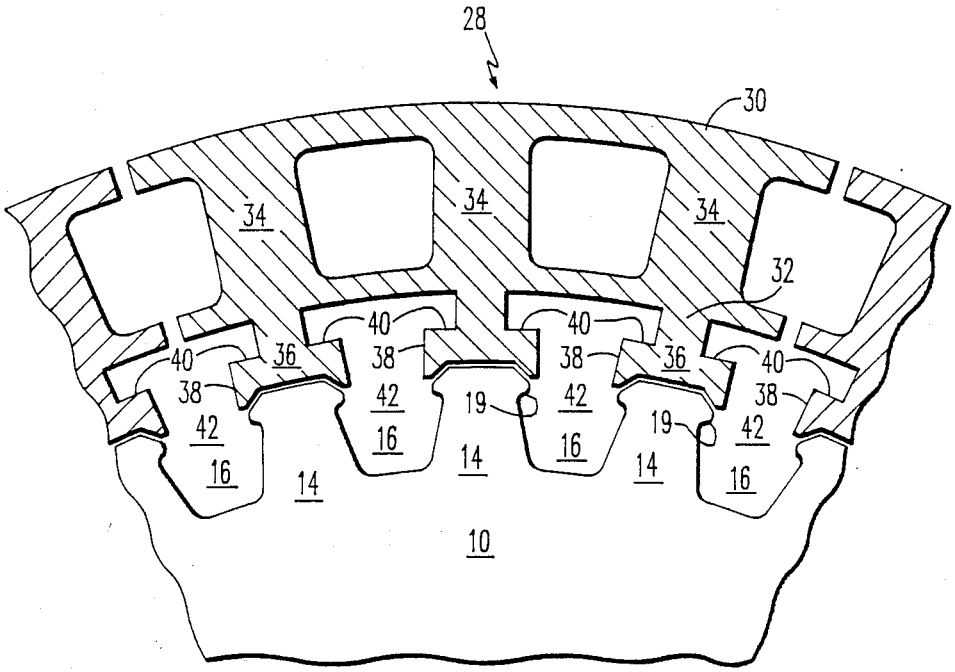
FIG. 3 illustrates a control stage blade group with integral shroud and platform configured for mating with rotor steeples of the present invention.

Turning now to FIG. 3, there is shown one form of the present invention in which an integral blade group with integral shroud and platform is placed in position adjacent rotor 10 and rotor steeples 14. The integral blade groups, indicated generally at 28, include an integral shroud 30, an integral platform 32 and a plurality of blade foils 34. The blade platform 32 includes a plurality of blade roots 36. Each of the blade roots 36 has a radially inner surface formed to mate with the radially outer end of each of the steeples 14. Preferably, each of the blade roots 36 has a single pair of oppositely disposed lugs 38 each of which includes a bearing surface 40. It will be noted that the integral blade group platform is formed so that when positioned over the steeples, the groove 42, defined between each of the adjacent roots, is aligned with the groove 16 defined between each adjacent pair of steeples 14. While other shapes are possible, it is desirable to form the groove 42 in the blade platform to have substantially a T-shaped configuration. This configuration provides an increased bearing surface area and more material in the connecting piece to be used to attach the blade group to the rotor. It should also be noted that the removal of the top portion 18 from each of the rotor steeples allows the platform 32 to be increased in depth so as to provide additional strength for transmitting the centrifugal force and the tangential steam force impacting on the blades 34. The integral shroud and platform virtually eliminate the bending moment in the root which is the primary cause of root cracking.

Figure 4:
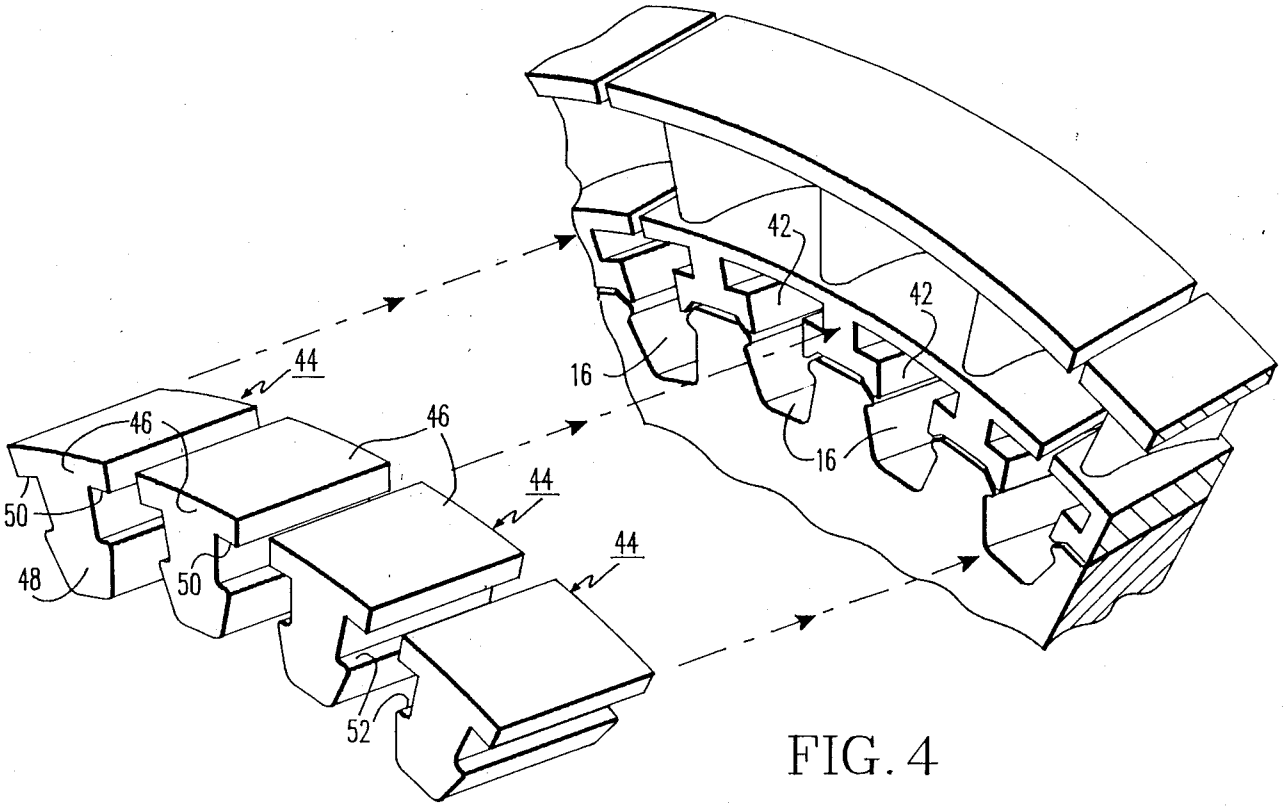
FIG. 4 illustrates a system and method of assembling a control stage blade group with integral shroud and platform to a turbine rotor.

Referring now to FIG. 4, there is shown a plurality of connecting pieces 44 shaped to conform to the groove 16 and groove 42 so as to enable connection of the integral shroud and platform blade group to a rotor. The connecting pieces 44 include a T-shaped top portion 46 which fits precisely within the platform groove 42. The connecting members 44 further include an inverted truncated triangle section 48 which fits within the rotor groove 16. Since the connecting members 44 can be inserted singly into the skewed rotor and platform grooves, the prior impossibility of assembly associated with the integral group of blades is avoided.

It should also be noted that any non-uniformity in pitch in the rotor grooves is not detrimental since the upper bearing surface 50 of the connecting member 44 is on a circle centered on the rotor axis 12 and further clearances are provided on the non-bearing sides of the connecting member 44. Axial movement of the integral blade groups may be prevented by suitable locking devices well known in the art. The section 48 includes bearing surfaces 52 adapted to mate with steeple bearing surfaces 19.

In the practice of the present invention, rotor grooves are formed in a turbine rotor so as to construct steeples extending radially outward of the rotor having a predetermined single lug configuration. A group of control stage blades are formed with an integral platform shroud with the depending roots of the blades having single opposed lugs and being formed to define a plurality of platform grooves between the depending roots. The roots and grooves are formed so as to be alignable with the corresponding grooves and steeples in the rotor. The ends of each of the steeples is shaped to form a truncated triangle and the mating ends of each of the roots is shaped to conform to the shape of the steeple tops. The integral platform is assembled on the rotor by positioning the roots in an abutting position with the integral platform and the groove in the rotor to connect the blade group to the rotor. Preferably, the lugs are formed so as to have bearing surfaces lying on an arc of a circle centered on a rotor axis.

While the invention has been described in what is presently considered to be a preferred embodiment, other modifications and arrangements will become apparent to those having skill in the art. For example, other groove and steeple or root configurations may be utilized without departing from the teaching of the present invention. Furthermore, while the invention has been described in conjunction with control stage blades with skewed side entry roots, it may be utilized with other kinds of turbine blades. It is intended therefore that the invention not be limited to the illustrative embodiment, but be interpreted in the full spirit and scope of the appended claims.

What is claimed is:

1. A system for attaching an integral platform blade group to a rotor of a steam turbine, the integral platform blade group comprising a plurality of blade foils connected into an integral group by a common platform, the system comprising:

a plurality of spaced roots formed on the platform and oriented so as to extend radially inward when the platform is positioned in a turbine, the roots being skewed with respect to an axis of the turbine rotor, a platform groove being defined between each adjacent pair of roots;

a plurality of circumferentially spaced steeples extending radially outward from the turbine rotor, a rotor groove being defined between each adjacent pair of steeples, each of the rotor grooves being aligned with a corresponding one of the platform grooves when the steeples are in abutting relationship with the roots, each platform spanning a plurality of said spaced steeples; and a plurality of connecting members adapted for insertion into the aligned grooves of the platform and rotor for connecting each integral blade group to the rotor.

2. The system of claim 1 wherein each steeple has a single pair of opposed lugs, each of the lugs having a radially inward bearing surface, each of the connecting members having a bearing surface for engaging the bearing surface of a corresponding steeple.

3. The system of claim 1 wherein each platform root includes a single pair of opposed lugs, each of the lugs having a bearing surface for mating with a bearing surface in a corresponding one of the connecting members for restraining the blade groups on the rotor.

4. The system of claim 2 wherein the bearing surfaces of the rotor steeples are aligned on an arc of a circle circumscribing the rotor axis.

5. The system of claim 3 wherein the bearing surfaces of the platform roots are aligned on an arc of a circle circumscribing the rotor axis.

* * * * *